US009551101B2

(12) United States Patent
Chang

(10) Patent No.: US 9,551,101 B2
(45) Date of Patent: Jan. 24, 2017

(54) CIRCULATION PROTECTION DEVICE OF CONVEYOR-DRIVEN FABRIC DYEING MACHINE

(71) Applicant: Chi-Lung Chang, Taoyuan (TW)

(72) Inventor: Chi-Lung Chang, Taoyuan (TW)

( * ) Notice: Subject to any disclaimer, the term of this patent is extended or adjusted under 35 U.S.C. 154(b) by 0 days.

(21) Appl. No.: 14/707,005

(22) Filed: May 8, 2015

(65) Prior Publication Data

US 2015/0337472 A1 Nov. 26, 2015

(30) Foreign Application Priority Data

May 20, 2014 (CN) ..... 2014 2 0258350 U

(51) Int. Cl.

| | |
|---|---|
| ***D06B 3/36*** | (2006.01) |
| ***D06B 3/24*** | (2006.01) |
| ***D06B 3/28*** | (2006.01) |
| ***D06B 23/00*** | (2006.01) |
| ***D06B 23/04*** | (2006.01) |

(52) U.S. Cl.

CPC . *D06B 3/36* (2013.01); *D06B 3/24* (2013.01); *D06B 3/28* (2013.01); *D06B 23/00* (2013.01); *D06B 23/04* (2013.01)

(58) Field of Classification Search

CPC ..... D06B 3/24; D06B 3/28; D06B 3/36
See application file for complete search history.

(56) References Cited

U.S. PATENT DOCUMENTS

| | | | | |
|---|---|---|---|---|
| 4,291,555 | A * | 9/1981 | Barriquand | D06B 3/28 26/1 |
| 5,235,828 | A * | 8/1993 | Aurich | D06B 3/206 226/158 |
| 5,520,027 | A * | 5/1996 | McCartney | D06B 3/28 68/13 R |
| 5,960,650 | A * | 10/1999 | Chi-Lung | D06B 23/04 68/177 |
| 2002/0174694 | A1* | 11/2002 | Bozzo | D06B 3/28 68/177 |
| 2002/0194886 | A1* | 12/2002 | Chen | D06B 15/10 68/177 |
| 2003/0126895 | A1* | 7/2003 | Glover | D06B 23/205 68/184 |
| 2009/0013479 | A1* | 1/2009 | Shimizu | D06B 23/22 8/159 |

* cited by examiner

*Primary Examiner* — Joseph L Perrin
(74) *Attorney, Agent, or Firm* — Leong C. Lei

(57) ABSTRACT

A circulation protection device is provided for a conveyor-driven fabric dyeing machine that includes a machine body having a front end in which a fabric circulation detection idler and a fabric movement sensor are mounted and a rear end in which a rear fabric guide and a fabric management device are mounted. Control is conducted with a computer program so that when the fabric circulation detection idler detects the fabric is not in movement, the conveyor is shut down; and when the fabric movement sensor detects the fabric is moving excessively fast or slow or gets jamming and stopped, the conveyor is controlled to automatically adjust the speed thereof or stops operation. When the fabric falls from a dyeing tube down to a conveyor, the rear fabric guide adjusts an entry angle of the fabric and the fabric management device allows the fabric to be orderly deposited on the conveyor.

5 Claims, 1 Drawing Sheet

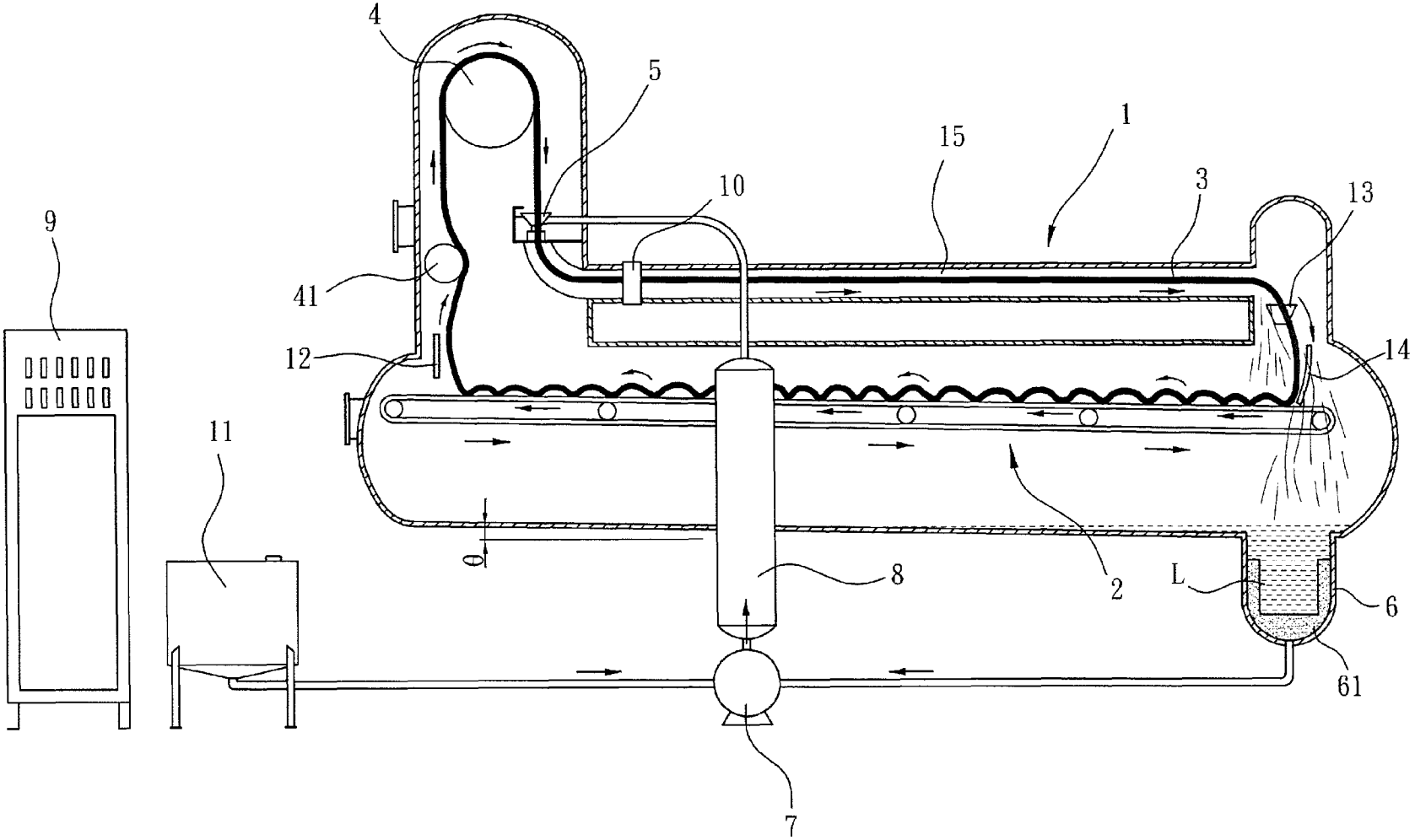
1
2
3
4
5
6
61
7
8
9
10
11
12
13
14
15
41
L
θ

CIRCULATION PROTECTION DEVICE OF CONVEYOR-DRIVEN FABRIC DYEING MACHINE

(a) TECHNICAL FIELD OF THE INVENTION

The present invention relates generally to a dyeing machine that is operable to dye fabrics, and more particularly to a dyeing machine that detects a moving condition and controls the operation of the dyeing machine in respect of circulation speed and shut-down or not and also manages uniform deposition of the fabric so as to achieve stable circulations of fabric and increase the throughput of fabric dyeing.

(b) DESCRIPTION OF THE PRIOR ART

In a fabric dyeing operation conducted in a conventional rope fabric dyeing machine, dye liquid is pressurized by a pump and is further processed by a heat exchanger for heating or cooling before entering a nozzle, which generates a hydraulic force through jetting or overflowing of the dye liquid for driving the fabric to advance and return back to a fabric accumulation tank of the dyeing machine. The fabric is then driven by a fabric roller (or without the fabric roller) to get into the nozzle. Thus, the hydraulic force of jetting or overflowing occurring in the nozzle helps move the fabric to circulate between a dyeing tube and a dyeing cylinder. In addition, the pump is also operable to feed chemical agents into the dyeing machine. During the circulation of the fabric together with the dye liquid, the heat exchanger helps achieve a temperature circle involving heating, temperature holding, and cooling, with which the fabric absorbs the dye liquid, whereby effects of refining, dyeing, and rinsing can be achieved.

In a rope fabric dyeing machine that includes a conveyor, the conveyor is arranged in the machine body of the dyeing machine and fabric is driven by a fabric roller to pass through a nozzle and a dyeing tube to return to and fall back onto the conveyor, and is then conveyed forward by the conveyor to completely a cycle of circulation during which dyeing proceeds. However, the conveyance speed of the fabric is subjected to variation, such as getting excessively fast or slot or even jamming, due to the difference of the material of the fabric itself or environmental conditions of the interior of the machine, such as temperature. In addition, the movement of the fabric may get unsmooth or the yield of dyeing may be affected, resulting from the angle of entry of the fabric or the accumulation of the fabric when the fabric falling from the dyeing tube back onto the conveyor.

SUMMARY OF THE INVENTION

An object of the present invention is to provide a conveyor-driven fabric dyeing machine that automatically detects if the speed is consistent during a conveyance process in order to automatically correct the conveyance speed or automatically shut down for the purposes of increasing the actual throughput of fabric dyeing, maintaining the quality of the fabric dyed, and protecting the machine from breaking down.

Another object of the present invention is to provide a conveyor-driven fabric dyeing machine that adjusts the angle at which fabrics entre a dyeing tube when fabrics move from the dyeing tube toward the conveyor or during a process in which multiple rope like fabrics are simultaneously subjected to dyeing, so as to help maintain stable and smooth circulations of the fabrics.

A further object of the present invention is to provide a conveyor-driven fabric dyeing machine that allows fabric to be stably and uniformly deposited and accumulated on the conveyor so as to help maintain stable circulation of the fabric and thus practically increase the throughput of fabric dyeing.

In an aspect of the present invention, a dyeing machine comprises a machine body having a front end in which a fabric circulation detection idler and a fabric movement sensor are mounted and control is conducted with a computer program so that when the fabric circulation detection idler detects fabric is not in movement inside the machine body, the conveyor shuts down or increases or decreases the speed thereof and when the fabric movement sensor detects the fabric moves excessively fast or slow or gets jamming and stops, a conveyor is controlled to automatically adjust the operation speed thereof or even stops the operation in order to prevent the fabric from jamming or being overly stretched so as to result in damage of the machine and the quality of the fabric.

In another aspect of the present invention, a dyeing machine comprises a machine body having a rear end in which a rear fabric guide and a fabric management device are mounted so that when fabric falls from a dyeing tube down onto a conveyor, the rear fabric guide adjusts the angle of the fabric entering the conveyor to make the circulation of the fabric stable and the fabric management device functions to have the fabric regularly, orderly, and uniformly deposited and accumulated on the conveyor to make the circulation of the fabric stable and to increase throughput of fabric dyeing so as to improve the circulating dyeing operation of the fabric.

A technical solution of the present invention is such that a dyeing machine comprises a machine body in which a dyeing tube is arranged and a conveyor arranged inside the machine body and a nozzle and a fabric roller mounted in the machine body so that the conveyor cyclically conveys the fabric through a fabric circulation detection idler and a fabric roller to enter a nozzle and pass through the dyeing tube to interact with dye liquid therein to get dyed; and a control box is provided for operation in combination with a computer program to control an operation of the fabric dyeing machine, wherein the fabric circulation detection idler and the fabric movement sensor are controlled by the control box so that when the fabric circulation detection idler detects the fabric is not in movement, the conveyor stops operation; and when the fabric movement sensor detects the fabric is moving excessively fast or slow or gets jamming, the conveyor is controlled to decrease or increase the operation speed thereof or even to stop the operation, wherein when necessary, the speed of the fabric circulation detection idler is detect to control or correct synchronization of the circulation speed of the fabric.

The machine body of the present invention comprises a rear end in which a rear fabric guide and a fabric management device are arranged so that when the fabric falls from the dyeing tube down to the conveyor, the rear fabric guide adjusts an angle of the fabric entering the conveyor to make circulation of the fabric stable and the fabric management device allows the fabric to be uniformly, stably, and orderly deposited on the conveyor to improve the circulating dyeing operation of the fabric and to increase throughput of fabric dyeing so as to improve the circulating dyeing operation of the fabric.

The present invention provides a fabric circulation detection idler and a fabric movement sensor arranged in a front end of a machine body to effectively detect the condition of moving of the fabric, which, when used in combination with an algorithm of a computer program, ensures that timely correction and adjustment, or even automatic shut-down, can be made when the conveyance speed of the fabric is abnormal so as to protect the fabric from being affected and even damaged by the abnormal conveyance speed and also to protect the machine from being damaged. Further, with a rear fabric guide and a fabric management device arranged in a rear end of the machine body, the angle at which the fabric falls from the dyeing tube onto the conveyor can be adjusted to ensure the smoothness of circulation of the fabric and improve throughput of fabric dyeing.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 1 is a schematic view showing the structure of a dyeing machine according to the present invention.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIG. 1, the present invention provides a circulation protection device of a conveyor-driven fabric dyeing machine, which comprises a dyeing tube 15 that is arranged above a machine body 1 to be horizontal or slightly inclined to receive fabric 3 to pass therethrough, a nozzle 5 and a fabric roller 4 that are arranged at even higher locations, a fabric circulation detection idler 41 that is located below the fabric roller 4, and a fabric movement sensor 12 that is mounted on a conveyor 2. A liquid storage tank 6 is arranged at a front end or a rear end of the machine body, depending the direction of inclination of the machine body 1. The liquid storage tank 6 is connected, at a bottom thereof, with a pipe that extends to the nozzle 5. The pipe also comprises a pump 7 and a heat exchanger 8 mounted thereon. The pump 7 is further connected by a pipe to a chemical agent tank 11. The conveyor 2 is arranged in the interior of the machine body 1. Preferably, the liquid storage tank 6 comprises a filter 61 arranged therein. In the rear end of the machine body 1, a rear fabric guide 14 is arranged above the conveyor 2 and a fabric management device 13 is arranged above the rear fabric guide 14.

When fed into the machine body, the fabric 3 is driven, through the fabric circulation detection idler 41, by the fabric roller 4 into the nozzle 5 to be further advanced into the dyeing tube 15 to move through the fabric management device 13 and the rear fabric guide 14 and eventually fall onto the conveyor 2 to be conveyed to a front end so as to completely a cycle of circulation. The pump 7 pumps dye liquid L that is contained in the liquid storage tank 6 through the heat exchanger 8 to be jetted through the nozzle 5 to help push the fabric 3 forward. The dye liquid L also interacts with the fabric 3 inside the nozzle 5 and the dyeing tube 15 so as to achieve dyeing of the fabric. The dye liquid L flows down from a rear end of the dyeing tube 15 back to the bottom of the machine body in such a way that the majority of the dye liquid L directly fall into the liquid storage tank 6, while a remaining portion of the dye liquid L follows the inclined bottom to flow into the liquid storage tank 6, to be then pumped again by the pump 7 and fed into the heat exchanger 8 to be jetted through the nozzle 5 into and flowing through the dyeing tube 15 to get back to the machine body 1 so as to complete a cycle of circulation.

Fluffs separated from the fabric 3 during the process of conveyance and dyeing can be filtered by the filter 61 to remove impurities when the dye liquid L is drawn out of the liquid storage tank 6.

Operation speeds of the fabric roller 4 and the conveyor 2 are controlled by a control box 9 in such a way as to be in synchronization with a circulation speed of the fabric 3. The speeds are adjustable; however, once set, the speeds are fixed constant speeds. In other words, the circulation speed of the fabric 3 is fixed. Thus, the time of each cycle of circulation is constant. The process of dyeing, which will be referred to as the dyeing process, is controlled based on a control unit that is defined by the number of cycles of fabric circulation detected by the fabric seam detector 10, based on which a computer or a programmable logic controller (PLC) of the control box 9 proceeds with the control of the dyeing process.

However, based on the control conducted with the control box 9, during the conveyance or movement of the fabric 3, when the fabric circulation detection idler 41 detects a situation that the fabric 3 is not in movement or is moved excessively fast or slow, the control box 9 instructs the conveyor 2 to stop operation or to increase or decrease the speed thereof; and when the fabric movement sensor 12 detects the conveyance speed of the fabric 3 on the conveyor 2 is excessively fast or slow, the control box 9 performs an automatic regulation of the operation speed by speeding up, slowing down, and simply halting the operation. When the fabric 3 is falling from the dyeing tube 15 onto the conveyor 2, the rear fabric guide 14 functions to adjust the angle at which the fabric 3 enters the conveyor 2 so as to make the circulation of the fabric 3 stable. The fabric management device 13 functions to make the fabric deposited and accumulated on the conveyor 2 in an orderly manner so as to make the circulation of the fabric 3 stable and thus achieve an increase of throughput of fabric dyeing.

In summary, the present invention comprises a fabric circulation detection idler 41 and a fabric movement sensor 12 that are arranged in a front end of a machine body 1 to effectively detect the condition of moving of the fabric 3, which, when used in combination with a control operation performed with a computer program, ensures that timely correction and adjustment, or even automatic shut-down, can be made when the conveyance speed of the fabric 3 is abnormal so as to protect the fabric 3 from being affected and even damaged by the abnormal conveyance speed and also to protect the machine from being damaged. With a rear fabric guide 14 and a fabric management device 13 arranged in a rear end of the machine body 1, the angle at which the fabric 3 falls from the dyeing tube 15 onto the conveyor 2 can be adjusted to allow the fabric 3 to stably and orderly deposited and accumulated on the conveyor 2 so as to ensure the smoothness of conveyance of the fabric and improve throughput of fabric dyeing.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A circulation protection device of a conveyor-driven fabric dyeing machine, comprising a machine body extending between a front end and a rear end, a dyeing tube arranged above the machine body and substantially parallel with the main body and a conveyor arranged in the machine body and comprising a movable member extending and movable between the front end and the rear end of the machine body, a nozzle and a fabric roller arranged above the front end of the machine body, and a control box that is operable in combination with a computer program to control an operation of the fabric dyeing machine, wherein a fabric circulation detection idler in the form of a roller that is arranged adjacent to the fabric roller for guiding fabric toward the fabric roller and is structured to detect a moving speed of the fabric moving towards the fabric roller and a fabric movement sensor, which is arranged in the front end of the machine body and adjacent to the movable member of the conveyor to detect a moving speed of the fabric leaving the conveyor, where the fabric circulation detection idler and the fabric movement sensor are electrically connected to the control box and the conveyor, wherein the control is performed by the control box in such a way that when the fabric circulation detection idler detects a situation that the fabric is not in movement according to the moving speed detected by the fabric circulation detection idler, the conveyor is shut down; and when the fabric movement sensor detects the fabric is moving excessively fast or slow or gets jamming and stopped according to the moving speed detected by the fabric movement sensor, the conveyor is controlled to automatically speed up or slot down or stops operation and wherein detection of a speed of the fabric circulation detection idler is made for correcting synchronization of speeds of the fabric and the conveyor.

2. The circulation protection device of the conveyor-driven fabric dyeing machine according to claim 1, wherein the machine body has a rear end in which a rear fabric guide and a fabric management device are arranged so that when the fabric falls from the dyeing tube down to the conveyor, the rear fabric guide adjusts an angle of the fabric entering the conveyor to make circulation of the fabric stable and the fabric management device allows the fabric to be uniformly, stably, and orderly deposited on the conveyor to improve the circulating dyeing operation of the fabric and to increase throughput of fabric dyeing.

3. The circulation protection device of the conveyor-driven fabric dyeing machine according to claim 2, wherein the fabric circulation detection idler, the fabric movement sensor, the rear fabric guide, and the fabric management device are mounted on the machine body.

4. The circulation protection device of the conveyor-driven fabric dyeing machine according to claim 2, wherein the fabric circulation detection idler, the fabric movement sensor, the rear fabric guide and the fabric management device are partly mounted on the machine body.

5. The circulation protection device of the conveyor-driven fabric dyeing machine according to claim 2, wherein the fabric circulation detection idler, the fabric movement sensor, the rear fabric guide and the fabric management device are individually mounted on the machine body.

* * * * *